US008456106B2

(12) United States Patent
Mednik et al.

(10) Patent No.: US 8,456,106 B2
(45) Date of Patent: Jun. 4, 2013

(54) LED DRIVER WITH EXTENDED DIMMING RANGE AND METHOD FOR ACHIEVING THE SAME

(75) Inventors: Alexander Mednik, Campbell, CA (US); Rohit Tirumala, Sunnyvale, CA (US)

(73) Assignee: Supertex, Inc., Sunnyvale, CA (US)

( * ) Notice: Subject to any disclaimer, the term of this patent is extended or adjusted under 35 U.S.C. 154(b) by 195 days.

(21) Appl. No.: 12/564,176

(22) Filed: Sep. 22, 2009

(65) Prior Publication Data

US 2010/0259177 A1 Oct. 14, 2010

Related U.S. Application Data

(60) Provisional application No. 61/168,985, filed on Apr. 14, 2009.

(51) Int. Cl.
*H05B 37/02* (2006.01)

(52) U.S. Cl.
USPC ..... 315/307; 315/291; 315/297; 315/209 R; 315/308

(58) Field of Classification Search
USPC ..... 315/291, 294, 185, 185 R, 159, 297, 315/307, 308, 312, 209 R
See application file for complete search history.

(56) References Cited

U.S. PATENT DOCUMENTS

2009/0273290 A1* 11/2009 Ziegenfuss ..... 315/193
2009/0322234 A1* 12/2009 Chen et al. ..... 315/159
2011/0062872 A1* 3/2011 Jin et al. ..... 315/122

* cited by examiner

*Primary Examiner* — Douglas W Owens
*Assistant Examiner* — Jonathan Cooper
(74) *Attorney, Agent, or Firm* — Weiss & Moy, P.C.; Jeffrey D. Moy

(57) ABSTRACT

A circuit for powering of a Light Emitting Diode (LED) string has a switching power converter. A brightness control circuit is coupled to the switching power converter to allow a duration of a conductive state of the power converter to exceed a duration of a conductive state of the LED string for maintaining a current magnitude in the LED string constant.

14 Claims, 2 Drawing Sheets

LED DRIVER WITH EXTENDED DIMMING RANGE AND METHOD FOR ACHIEVING THE SAME

RELATED APPLICATION

The present patent application is related to U.S. Provisional Application Ser. No. 61/168,985, filed Apr. 14, 2009, in the name of the same inventors listed above, and entitled, "LED DRIVER WITH EXTENDED DIMMING RANGE AND METHOD FOR ACHIEVING THE SAME". The present patent application claims the benefit under 35 U.S.C. §119(e).

BACKGROUND

The present invention relates generally to a Light Emitting Diode (LED) driver and, more specifically, to an LED driver having an extended dimming range.

Recent developments of high-brightness light emitting diodes (LED) have opened new horizons in lighting. Highly efficient and reliable LED lighting continuously wins recognition in various areas of general lighting, especially in areas where cost of maintenance is a concern.

A wide dynamic range of the LED brightness control becomes important in many applications, such as automobiles, avionics and television. In some cases it is needed due to large variation in the ambient light, in others it allows to improve the contrast ratio of a display. Due to the color and chromaticity properties of LED's, it is beneficial to control brightness of an LED through pulse width modulation of the current in it, while maintaining the current magnitude at a fixed level. This LED brightness control method is commonly referred to as the PWM dimming.

Presently, the brightness control range of current circuits is limited to the minimum on time of a switch needed to maintain the current magnitude in the LED string. When the output pulse width of a generator becomes shorter than the on-time of the switch needed for the current sense voltage to reach the error voltage level, the control over the LED string current is lost, and the current drops out of regulation. This limit is more restrictive, when an inductor is operated in continuous conduction mode (CCM), since a longer time is needed for it to develop its steady-state current.

Therefore, it would be desirable to provide a circuit and method that overcomes the above problems.

SUMMARY

A circuit for powering of a Light Emitting Diode (LED) string has a switching power converter. A brightness control circuit is coupled to the switching power converter to allow a duration of a conductive state of the power converter to exceed a duration of a conductive state of the LED string for maintaining a current magnitude in the LED string constant.

A method of achieving wide dimming range in an LED driver of a boost type having an inductor and a current control feedback comprising: storing a state of a current control feedback upon a falling edge of the PWM signal; and disabling switching of the LED driver after the falling edge of the PWM signal and upon an inductor meeting a reference corresponding to a stored state of a current control feedback.

The features, functions, and advantages can be achieved independently in various embodiments of the disclosure or may be combined in yet other embodiments.

BRIEF DESCRIPTION OF THE DRAWINGS

Embodiments of the disclosure will become more fully understood from the detailed description and the accompanying drawings, wherein.

DETAILED DESCRIPTION

Figure 1:
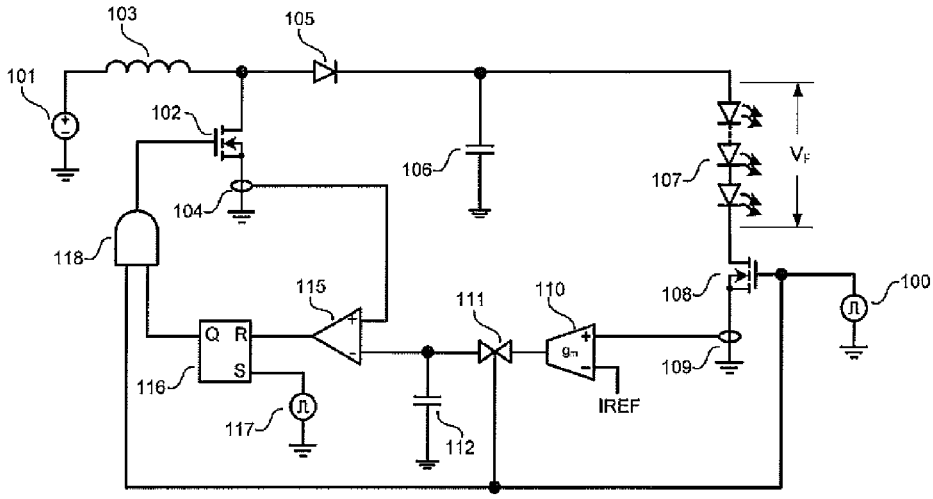
Prior Art Figure 1
FIG. 1 shows one example of a PWM dimming scheme in a prior art LED driver of the boost type.

A boost converter is one DC/DC converter topology commonly used to drive a string of LEDs. In the prior art, PWM dimming techniques are used that allow controlling the LED brightness in a boost converter within reasonably wide limits. Referring now to FIG. 1, one example of a PWM dimming scheme in a prior art LED driver of the boost type is shown. The boost converter power train (hereinafter boost converter) in the FIG. 1 includes an inductor 103 receiving input power from an input voltage source 101 via a power switch 102, and delivering power to an output filter capacitor 106 and an LED string 107 via a rectifier diode 105.

The brightness control circuit of the boost converter of FIG. 1 includes a PWM switch 108 receiving a brightness control signal from a PWM pulse generator, the PWM switch 108 periodically disconnecting the LED string 107 from the output of the boost converter when the output of the PWM pulse generator 100 is low. The brightness control circuit also includes an LED current sense element 109; an error amplifier 110 having a reference IREF and a compensator network 112; a hold switch 111 for disconnecting the compensator network 112 from the output of the error amplifier 110 when the output of the PWM pulse generator 100 is low; a peak current sense element 104 for detecting peak current in the inductor 103; a current sense comparator 115 for comparing the output of the current sense element 104 with an error voltage at the compensator network 112, and for generating a reset signal when the error voltage is exceeded; a PWM latch turning the power switch 102 on upon receiving a clock signal 117, and turning the switch 112 off upon receiving the reset signal; a logic gate 118 for inhibiting the turn on of the switch 102 when the output of the PWM pulse generator 100 is low.

The brightness control range of the circuit of FIG. 1 is limited to the minimum on time of the switch 102 needed to maintain the current magnitude in the LED string 107. When the output pulse width of the generator 100 becomes shorter than the on-time of the switch 102 needed for the current sense 104 voltage to reach the error voltage level, the control over the LED string current is lost, and the current drops out of regulation. This limit is more restrictive, when the inductor 103 is operated in continuous conduction mode (CCM), since a longer time is needed for it to develop its steady-state current.

Figure 2:
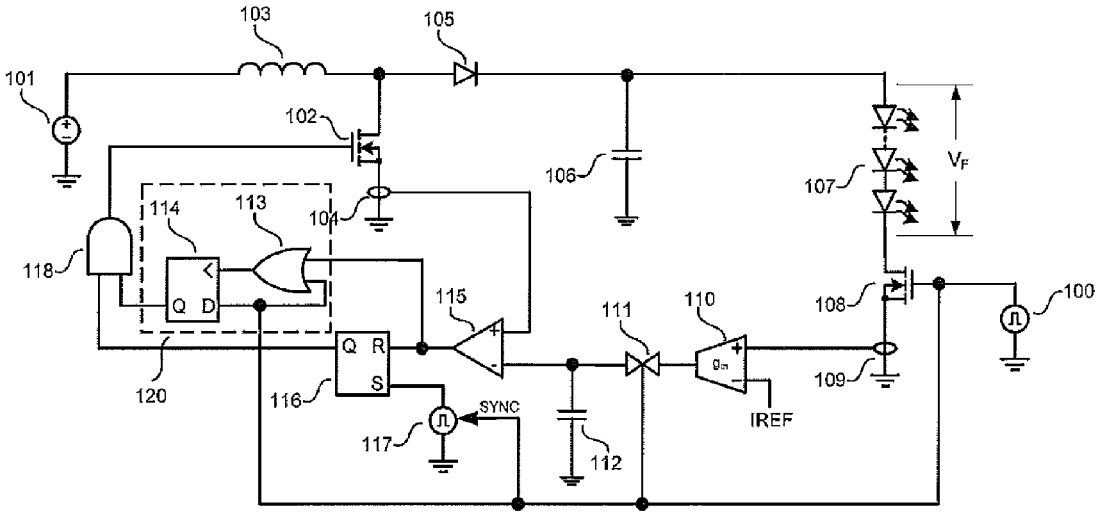
FIG. 2 shows an LED driver of the boost type employing a modified PWM dimming control scheme of the present invention, which overcomes the above limitation of the minimum dimming duty ratio.

Referring now to FIG. 2, an LED driver 130 of the boost type employing a modified PWM dimming control scheme of the present invention is shown. The LED driver 200 of FIG. 2 overcomes the above limitation of the minimum dimming duty ratio.

The LED driver of FIG. 2 includes an inductor 103 receiving input power from an input voltage source 101 via a power switch 102, and delivering power to an output filter capacitor 106 and an LED string 107 via a rectifier diode 105.

Like in FIG. 1, a brightness control circuit 132 of the boost converter 130 of FIG. 2 includes a PWM switch 108 which is coupled to the LED string 107. The PWM switch 108 receives a brightness control signal from a PWM pulse generator 100. The PWM switch 108 periodically disconnects the LED string 107 from the output of the boost converter when the output of the PWM pulse generator 100 is low.

The brightness control circuit 202 further includes an LED current sense element 109 coupled to the PWM switch 108. An error amplifier 110 has a first input coupled to the LED current sense element 109. A second input of the error amplifier 110 is coupled to a reference TREF. The output of the error amplifier 110 is coupled to a hold switch 111. The hold switch 111 is used for disconnecting a compensator network 112 from the output of the error amplifier 110 when the output of the PWM pulse generator 100 is low.

A peak current sense element 104 is coupled to the power switch 102. The peak current sense element is used for detecting peak current in the inductor 103. A current sense comparator 115 has a first input coupled to the peak current sense element 104 and a second input coupled to the compensator network 112. The current sense comparator 115 is used for comparing the output of the current sense element 104 with an error voltage at the compensator network 112 and for generating a reset signal when the error voltage is exceeded. A PWM latch 116 has a reset input coupled to the output of the current sense comparator 115 and a set input coupled to a clock signal 117. The PWM latch 116 turns the power switch 102 on upon receiving a clock signal 117, and turning the switch 112 off upon receiving the reset signal. A logic gate 118 is used for inhibiting the turn on of the switch 102 when the output of the PWM pulse generator 100 is low.

In FIG. 2, a logic block 120 is used for maintaining the power switch 102 in the conductive state until the signal of the current sense element 104 exceeds the error voltage at the compensator network 112, regardless of the PWM pulse generator 100 state.

In accordance with one embodiment, the logic block 120 comprises a logic gate 113 and a D-type flip-flop 114. The logic gate 113 has a first input coupled to the output of the current sense comparator 115 and a second input coupled to the PWM pulse generator 100. The output of the logic gate 113 is coupled to a clock input of the D-type flip-flop 114. In the embodiment shown in FIG. 2, the logic gate 113 is an OR gate.

The D input of the D-type flip-flop 114 is coupled to the PWM pulse generator 100. The Q output of the D-type flip-flop 114 is coupled to a first input of the logic gate 118. The second input of the logic gate 118 is coupled to the output of the PWM latch 116.

Figure 3:
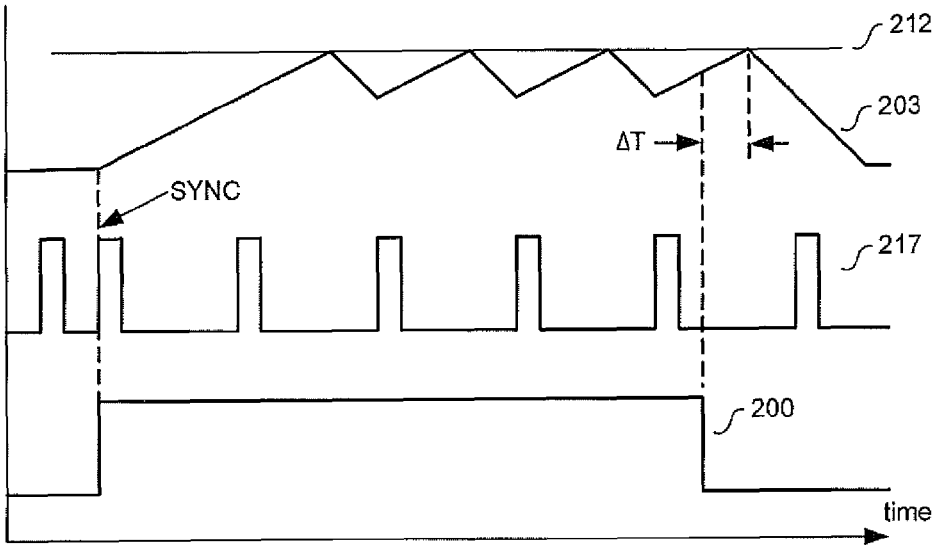
FIG. 3 is a chart illustrating waveforms during operation of the circuit of FIG. 2.

Referring now to FIG. 3, FIG. 3 illustrates operation of the circuit of FIG. 2. The rising edge of the PWM signal 200 from the generator 100 propagates through the logic gate 113, and the D-type flip-flop 114 stores a logic-high state. This high output state of the D-type flip-flop 114 enables turn-on of the power switch 102 through the logic gate 118. The beginning pulse of the clock signal 117 represented by the waveform 217 is synchronized with the rising edge of the PWM signal 200. At the falling edge of the PWM signal 200, the switching of the power switch 102 will continue until the current in the inductor 103 represented by the waveform 203 reaches the reference 212 reflecting the error voltage at the compensator 112. At this moment, the flip-flop 114 receives a signal from the comparator 115 through the logic gate 113, and the output of the flip-flop 114 stores the logic-low state of the PWM signal generator 100. Therefore, the actual turn-off transition of the boost converter occurs after a delay AT. Thus, the circuit depicted in FIG. 2 is able to maintain the current control loop closed even when the PWM dimming signal 200 pulse width is shorter than one switching cycle of the boost converter.

Figure 4:
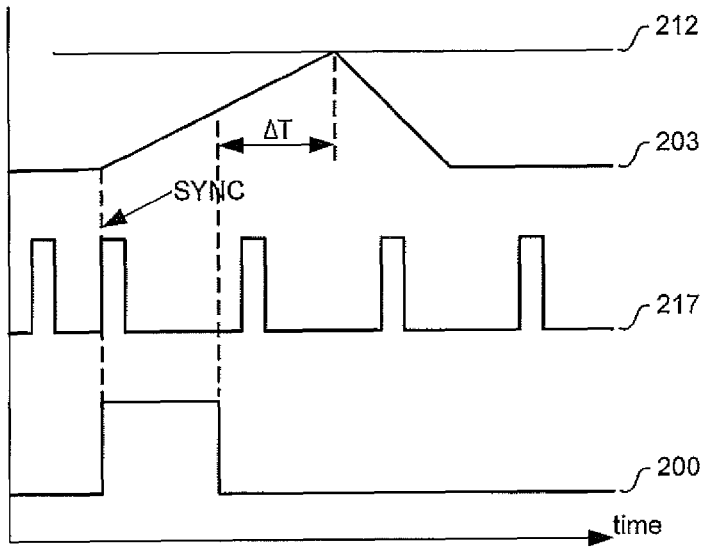
FIG. 4 is a chart illustrating waveforms during operation of the circuit of FIG. 2.

FIG. 4 shows the corresponding waveforms similar to the ones of FIG. 3. Upon the rising edge of the signal 200, the inductor current 203 must reach the reference 212 at least once, before switching of the switch 102 is disabled. The clock signal 117 may be kept running, or it may be stopped after the delay AT, as long as it is synchronized with the rising edge in every cycle of the waveform 200.

Referring to FIGS. 2-4, a method of operation is disclosed that achieves a wide dimming range in the LED driver 140 of the boost type having an inductor 103 and a current control feedback. First, one should synchronize switching of the boost converter with the rising edge of the PWM signal 200 from the generator 100. Next, the state of the current control feedback upon the falling edge of the PWM signal 200 is stored. The LED load 107 is disconnected from the output of the boost converter upon the falling edge of the PWM signal 200. Switching of the boost converter is disabled after the falling edge of the PWM signal 200, but not until the inductor 103 meets a reference corresponding to the stored state of the current control feedback.

While embodiments of the disclosure have been described in terms of various specific embodiments, those skilled in the art will recognize that the embodiments of the disclosure can be practiced with modifications within the spirit and scope of the claims.

What is claimed is:

1. A circuit for powering of a Light Emitting Diode (LED) string comprising:

a switching power converter; and a brightness control circuit coupled to the switching power converter;

wherein the brightness control circuit has a logic control block coupled to a brightness control signal and to a device for generating an error signal when an error voltage is exceeded, the logic control block sending a signal to maintain a conductive state of a switch of the switching power converter until the error voltage monitored at a compensator network of the brightness control circuit is exceeded for maintaining a current magnitude in the LED string constant;

wherein the logic control block comprises:

a logic gate having a first input coupled to a current sense comparator of the brightness control circuit and a second input coupled to a PWM pulse generator of the brightness control circuit; and a flip flop, wherein an output of the logic gate is coupled to a clock input of the flip flop, an input of the flip flop coupled to the PWM pulse generator of the brightness control circuit, and an output of the flip flop coupled to a brightness control circuit logic gate.

2. A circuit for powering of a Light Emitting Diode (LED) string in accordance with claim 1 wherein the brightness control circuit is coupled to the switching power converter to synchronize a sequence of conductive states of the power converter with a beginning of a conductive state of the LED string.

3. A circuit for powering of a Light Emitting Diode (LED) string in accordance with claim 1 wherein the switching power converter comprises:

an input voltage source;

an inductor coupled to the input voltage source;

a power switch coupled to the inductor; and wherein the LED string is coupled to the inductor.

4. A circuit for powering of a Light Emitting Diode (LED) string in accordance with claim 1 wherein the switching power converter is of a boost type.

5. A circuit for powering of a Light Emitting Diode (LED) string in accordance with claim 3 wherein the brightness control circuit comprises:

an LED current sense element coupled to the LED string;

an error amplifier having a first input coupled to the LED current sense element and a second input coupled to a reference;

a hold circuit coupled to an output of the error amplifier;

a peak current sense element coupled to the inductor;

a PWM circuit coupled to the power switch to allow conduction of the power switch until a signal from the peak current sense element exceeds a level determined by the hold circuit;

a PWM switch coupled to the LED string; and a PWM pulse generator coupled to the PWM switch to inhibit its conduction, and coupled to the PWM circuit to inhibit conduction of the power switch upon the signal from the peak current sense element having exceeded the level determined by the hold circuit.

6. A circuit for powering of a Light Emitting Diode (LED) string in accordance with claim 5 wherein the error amplifier includes the compensator network comprising a compensation capacitor.

7. A circuit for powering of a Light Emitting Diode (LED) string in accordance with claim 6 wherein the hold circuit comprises a hold switch and a hold capacitor, and wherein the compensation capacitor is utilized as the hold capacitor.

8. A circuit for powering of a Light Emitting Diode (LED) string in accordance with claim 3 wherein the brightness control circuit comprises:

a PWM switch coupled to the LED string;

a PWM pulse generator coupled to the PWM switch to enable conduction of the PWM switch;

a PWM circuit coupled to the power switch to enable conduction of the power switch; and an oscillator circuit coupled to the PWM circuit for generating a pulse sequence to repetitively initiate a conductive state of the power switch, wherein the pulse sequence is synchronized with each pulse of the PWM pulse generator.

9. A circuit for powering of a Light Emitting Diode (LED) string comprising:

a switching power converter, wherein the switching power converter comprises:

an input voltage source;

an inductor coupled to the input voltage source;

a power switch coupled to the inductor; and wherein the LED string is coupled to the inductor; and a brightness control circuit coupled to the switching power converter;

wherein the brightness control circuit has a logic control block coupled to a brightness control signal and to a device for generating an error signal when an error voltage is exceeded, the logic control block sending a signal to maintain a conductive state of a switch of the switching power converter until the error voltage monitored at a compensator network of the brightness control circuit is exceeded for maintaining a current magnitude in the LED string constant;

wherein the logic control block comprises:

a logic gate having a first input coupled to a current sense comparator of the brightness control circuit and a second input coupled to a PWM pulse generator of the brightness control circuit; and a flip flop, wherein an output of the logic gate is coupled to a clock input of the flip flop, an input of the flip flop coupled to the PWM pulse generator of the brightness control circuit, and an output of the flip flop coupled to a brightness control circuit logic gate.

10. A circuit for powering of a Light Emitting Diode (LED) string in accordance with claim 9 wherein the switching power converter is of a boost type.

11. A circuit for powering of a Light Emitting Diode (LED) string in accordance with claim 9 wherein the brightness control circuit comprises:

an LED current sense element coupled to the LED string;

an error amplifier having a first input coupled to the LED current sense element and a second input coupled to a reference;

a hold circuit coupled to an output of the error amplifier;

a peak current sense element coupled to the inductor;

a PWM circuit coupled to the power switch to allow conduction of the power switch until a signal from the peak current sense element exceeds a level determined by the hold circuit;

a PWM switch coupled to the LED string;

a PWM pulse generator coupled to the PWM switch to inhibit its conduction, and coupled to the PWM circuit to inhibit conduction of the power switch upon the signal from the peak current sense element having exceeded the level determined by the hold circuit.

12. A circuit for powering of a Light Emitting Diode (LED) string in accordance with claim 11 wherein the error amplifier includes the compensator network comprising a compensation capacitor.

13. A circuit for powering of a Light Emitting Diode (LED) string in accordance with claim 12 wherein the hold circuit comprises a hold switch and a hold capacitor, and wherein the compensation capacitor is utilized as the hold capacitor.

14. A circuit for powering of a Light Emitting Diode (LED) string in accordance with claim 9 wherein the brightness control circuit comprises:

a PWM switch coupled to the LED string;

a PWM pulse generator coupled to the PWM switch to enable conduction of the PWM switch;

a PWM circuit coupled to the power switch to enable conduction of the power switch;

an oscillator circuit coupled to the PWM circuit for generating a pulse sequence to repetitively initiate a conductive state of the power switch, wherein the pulse sequence is synchronized with each pulse of the PWM pulse generator.

* * * * *